United States Patent [19]

Instone, Jr.

[11] 4,376,559

[45] Mar. 15, 1983

[54] DUPLEX GROUNDING

[75] Inventor: John C. Instone, Jr., Somerdale, N.J.

[73] Assignee: SGL Industries, Inc., Haddonfield, N.J.

[21] Appl. No.: 205,517

[22] Filed: Nov. 10, 1980

[51] Int. Cl.[3] ..... H01R 4/66

[52] U.S. Cl. ..... 339/14 R

[58] Field of Search ..... 339/14 R, 14 L, 31 R, 339/31 M, 164 R, 164 L, 164 M; 174/51

[56] References Cited

U.S. PATENT DOCUMENTS

| | | | |
|---|---|---|---|
| 2,969,518 | 1/1961 | Slater | 339/31 M |
| 3,089,042 | 5/1963 | Hickey et al. | 307/147 |
| 3,118,714 | 1/1964 | Ludwig | 339/14 R |
| 3,868,161 | 2/1975 | Frantz | 339/14 R |
| 3,900,238 | 8/1975 | Anderson | 339/14 R |

*Primary Examiner*—Eugene F. Desmond

*Attorney, Agent, or Firm*—Cushman, Darby & Cushman

[57] ABSTRACT

A receptacle, such as one for a duplex electrical outlet, includes a grounding plate facilitating ready grounding of the receptacle. A conventional ground screw is provided at one end of the receptacle and the grounding plate abuts the receptacle housing and has an opening therein for receipt of the ground screw, and a contoured surface extending away from the opening and for operatively engaging a ground object. The ground object may comprise a face plate for the receptacle, the grounding plate having a serrated edge abutting the face plate. Alternatively, the ground object can be a ground wire, in which case the grounding plate contoured surface comprises an arm having a V-shaped notch, or a strip with a tongue pressed from it, for receiving the ground wire.

10 Claims, 8 Drawing Figures

Fig. 5
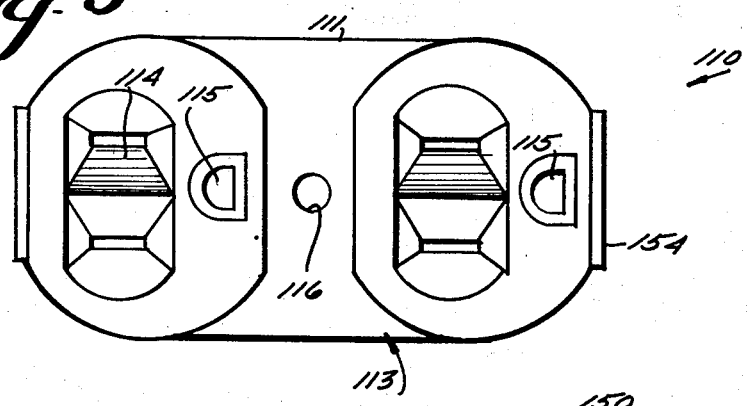
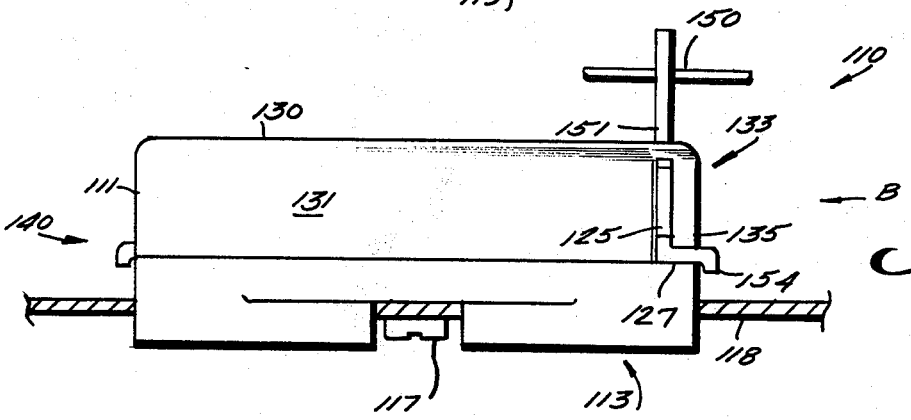
Fig. 6
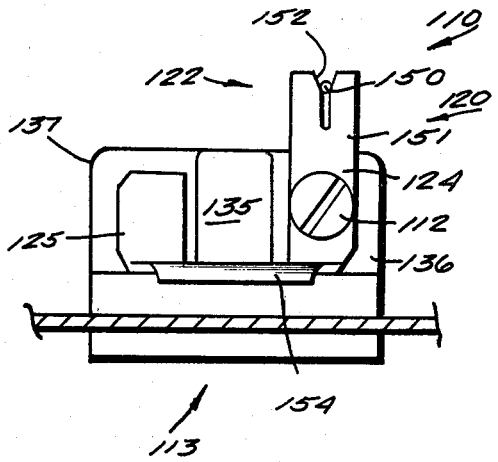
Fig. 7
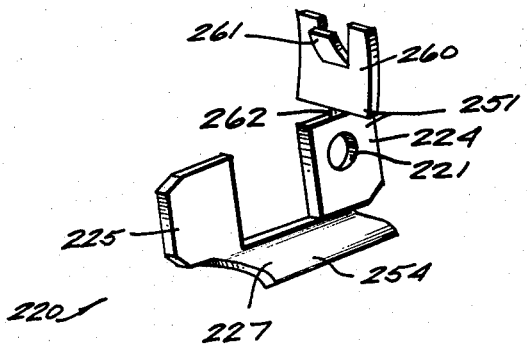
Fig. 8

DUPLEX GROUNDING

BACKGROUND AND SUMMARY OF THE INVENTION

Conventional receptacles, for single and duplex electrical outlets, switches, indicator lights, and the like, conventionally have a ground screw extending from the receptacle housing to which a ground wire is connected. The wire is attached to the ground screw either by wrapping it around the screw and then tightening the screw, or by attaching a "grounding lug" to the ground screw and then wiring the "grounding lug". Such grounding is necessarily time-consuming, especially when the receptacles are being assembled in a multiple electrical outlet strip (such as shown in U.S. Pat. No. 4,113,334, the disclosure of which is hereby incorporated by reference herein) or the like.

According to the present invention, a grounding plate for a conventional receptacle having a conventional ground screw associated therewith is provided which simplifies grounding of the receptacle, providing for ready utilization of the receptacle, and ready assembling of the receptacle into a multiple electrical outlet strip. The receptacle may include a single or duplex electrical outlet, a switch, or the like, and has hot and neutral wire-receiving structures associated therewith. The hot and neutral wire-receiving structures may be terminals such as are illustrated in U.S. Pat. No. 4,113,334, or may comprise the particularly formed receptacle bodies illustrated and described in copending application Ser. No. 190,050, filed Sept. 23, 1980 (the disclosure of which is hereby incorporated by reference herein), or like suitable structure.

According to the present invention, means are associated with the ground screw for grounding the receptacle, the means comprising a grounding plate abutting the housing and having means defining an opening therein for receipt of the ground screw, and having a contoured surface extending away from the opening and for operatively engaging a ground object.

The ground object may comprise a face plate covering the receptacle face (such as a cover plate of a multiple electrical outlet strip) which in turn may be connected to a common ground wire in a wiring system. In such a situation, the contoured surface comprises an elongated serrated edge extending toward and engaging the face plate. The grounding plate may comprise first and second inner faces receiving a rib of the receptacle housing therebetween, with a web portion interconnecting the inner faces with a grounding face having the serrated edge formed thereon. The ground screw-receiving opening is formed in one of the inner faces.

Where the ground object is a ground wire, such as a common ground wire for a plurality of receptacles in a multiple electrical outlet strip or the like, the contoured surface comprises an arm extending outwardly from the receptacle back substantially perpendicular thereto, and having a ground wire-receiving surface manifestation formed thereon. The ground wire-receiving surface manifestation may comprise a V-shaped notch extending substantially parallel to the ground screw-receiving opening, or may comprise a strip having a tongue pressed therefrom to define an open-ended slot between the tongue and the remainder of the strip, for receiving the ground wire in the slot. In the latter case, the strip may be disposed in a plane substantially perpendicular to the plane of the grounding plate portion having the ground screw-receiving opening therein.

It is the primary object of the present invention to provide a metal grounding plate, and a receptacle utilizing such grounding plate, providing for easy grounding of the receptacle, such as when wiring the receptacle in a multiple electrical outlet strip or the like. This and other objects of the present invention will become clear from an inspection of the detailed description of the invention, and from the appended claims.

BRIEF DESCRIPTION OF THE DRAWINGS

FIG. 5 is a top plan view of another exemplary embodiment of a receptacle according to the present invention;

FIG. 6 is a side view of the receptacle of FIG. 5 shown in conjunction with a face plate;

FIG. 7 is an end view of the structure of FIG. 6 looking in the direction of arrow B of FIG. 6; and FIG. 8 is a perspective view of another embodiment of a grounding plate according to the present invention, which may be utilizable in place of the grounding plate illustrated in conjunction with the receptacle in FIGS. 5 through 7.

DETAILED DESCRIPTION OF THE DRAWINGS

Figure 1:
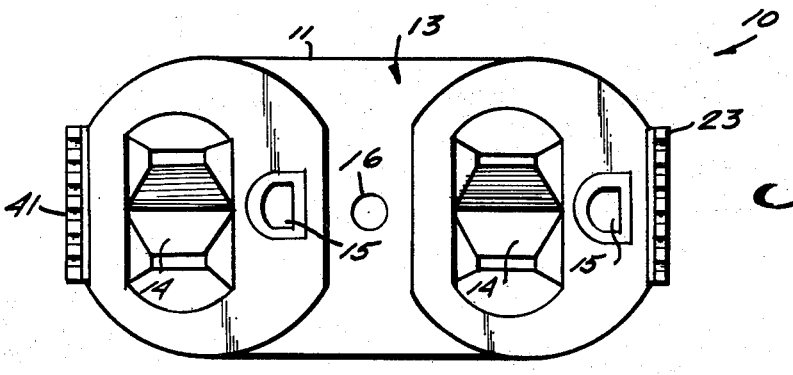
FIG. 1 is a top plan view of a face of a receptacle according to the present invention.
Figure 2:
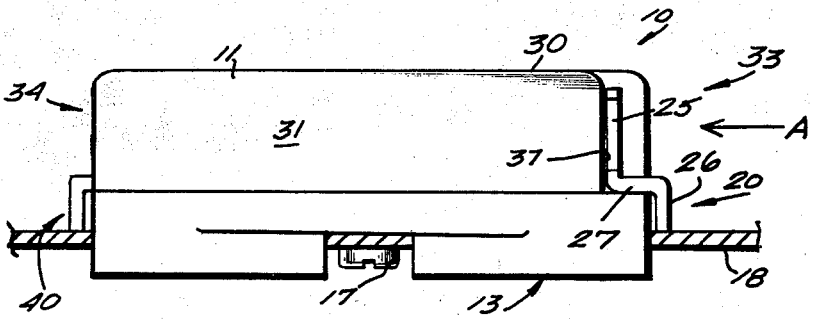
FIG. 2 is a side view of the receptacle of FIG. 1 shown in conjunction with a face plate.
Figure 3:
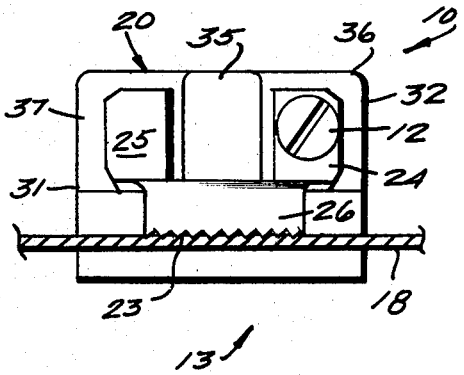
FIG. 3 is an end view of the structure of FIG. 2 looking in the direction of arrow A.
Figure 4:
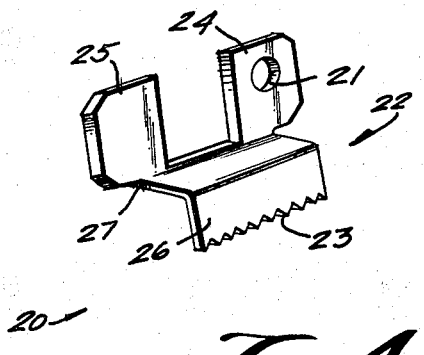
FIG. 4 is a perspective view of an exemplary grounding plate according to the present invention, as provided in the receptacle of FIGS. 1 through 3.

An exemplary receptacle according to the present invention is illustrated generally at 10 in FIGS. 1 through 3. The receptacle includes a housing 11 having hot and neutral wire-receiving structures associated therewith. The hot and neutral wire-receiving structures are not shown in the drawings for clarity of illustration however, they may comprise terminals such as shown in U.S. Pat. No. 4,113,334, or wire-receiving housing structures such as illustrated in copending application Ser. No. 190,050, filed Sept. 23, 1980, or the like. The housing 11 has a ground screw 12 provided at one end thereof.

The receptacle 10 can be for a single electrical outlet, a switch, an indicator light, or the like, and in the embodiment illustrated in the drawings, it comprises a duplex electrical outlet, the face 13 of the housing 11 having two sets of electrical prong-receiving structures 14 associated therewith, including openings 15 for receipt of a ground prong. Additionally, a threaded opening 16 may be provided in the face 13 of the receptacle 10 for receipt of a screw 17 (see FIG. 2) for holding the receptacle to a face plate 18, with the electrical plug-receiving structures 14 extending outwardly from the face plate 18. The face plate 18 may be a cover plate for a multiple electrical outlet strip.

According to the present invention, means are associated with the ground screw 12 for grounding the receptacle, said means comprising a grounding plate. One form that the grounding plate may take is illustrated generally at 20 in FIGS. 1 through 4. As illustrated in FIGS. 1 through 3, the grounding plate 20 abuts the housing 11 and includes means defining an opening 21

(see FIG. 4) therein for receipt of the ground screw 12, and having a contoured surface 22 extending away from the opening 21 and for operatively engaging a ground object.

As illustrated in FIGS. 1 through 4, the contoured surface 22 of the grounding plate 20 comprises an elongated serrated edge 23 extending toward the receptacle face 13 and engaging the face plate 18. The metal grounding plate 20 is preferably constructed so that it has at least one inner face, and preferably first and second inner faces 24, 25, which are substantially parallel and spaced apart. The grounding plate 20 further comprises a grounding face 26 which has the serrated edge 23 formed thereon, and a web portin 27, substantially perpendicular to the inner faces 24, 25 and the grounding face 26, interconnects these faces. The ground screw-receiving opening 21 is formed in the first inner face 24.

The receptacle housing 11, as illustrated most clearly in FIGS. 2 and 3, includes a back 30, first and second opposite long sides 31, 32, first and second opposite short sides 33, 34, and a center rib 35 in the first short side 33, with a pair of indented faces 36, 37 on either side of the rib 35. The inner faces 24, 25 are spaced apart a distance sufficient to receive the rib 35 therebetween, and are flush with the indented faces 36, 37, respectively. The ground screw 12 extends through the face 24, and face 36, into the interior of the receptacle housing 11, making contact with any suitable grounding structure cooperating with the ground prong-receiving openings 15.

In order to appropriately mount the receptacle housing 11 with a face plate 18, or the like, a dummy grounding plate 40 may be mounted on the short side 34 of the housing 11, and include a serrated edge 41 thereof which also engages plate 18.

In the embodiment illustrated in FIGS. 5 through 7, a receptacle 110 is illustrated. All of the components of the receptacle 110 corresponding to those of the receptacle 10 have the same reference numeral, except it is preceded by a "1". In this embodiment, the ground object is a conventional ground wire 150, such as a common ground wire for a plurality of receptacles 111 in a multiple electrical outlet strip or the like. Therefore, the grounding plate 120 comprises as its contoured surface 122 an arm 151 extending outwardly from the receptacle back 130 substantially perpendicular thereto, and having a ground wire 150 receiving surface manifestation formed thereon. The ground wire-receiving surface manifestation comprises a V-shaped notch 152 (see FIG. 7) extending substantially parallel to the ground screw 112, and ground screw-receiving opening (not shown).

The arm 151 preferably is integral with one of the inner faces 124, 125 (preferably first inner face 124), and coplanar therewith. A lip 154 is parallel to faces 124, 125, and spaced therefrom, and interconnected thereto with web portion 127, the lip 154 engaging a portion of the short side face 133 of housing 111. A dummy grounding plate 140 may also be provided in this embodiment, if desired.

In the embodiment of the grounding plate 220 illustrated in FIG. 8, like structures have the reference numerals as in the FIGS. 1 through 4 and FIGS. 5 through 7 embodiments, only are preceded by a "2". In this embodiment, the arm 251 includes as the ground wire-receiving surface manifestation a strip 260 having a tongue 261 pressed therefrom to define an open-ended slot between the tongue 261 and the remainder of the strip 260, for receiving a ground wire in the slot. In this regard, the tongue and strip arrangement may be identical to the tongue and strip arrangement for the terminals 46 and 48 illustrated in U.S. Pat. No. 4,113,334. Preferably the strip 260 is disposed in a plane substantially perpendicular to the plane of the face 224 (having the opening 221 therein for receipt of a ground screw), a thin twisted section 262 being provided between arm 251 and strip 260.

In the description of all of the embodiments of the present invention, the term "ground screw", and "ground screw-receiving opening", have been utilized since the great majority of conventional receptacles utilize a ground screw, and thus the grounding plates according to the present invention are readily utilizable therewith. However, those terms should be given a broad interpretation when considering the present specification and claims so as to encompass equivalent grounding components associated with receptacles, with which the grounding plates according to the present invention may be utilized.

An exemplary manner of utilization of the receptacle 10 according to the present invention will now be set forth:

The ground screw 12 extending through housing 11 into operative association with ground prong-receiving openings 15 is removed, and the grounding plate 20 placed in association with receptacle housing short side 33. Faces 24 and 25 of grounding plate 20 are moved into abutting engagement with indented faces 36 and 37 of receptacle housing 11, with opening 21 aligned with the ground screw-receiving opening in the housing 11, and with serrated edge 23 extending toward receptacle face 13. The ground screw 12 is then passed through opening 21 in the aligned opening in the housing 11, holding the grounding plate 20 in place and connecting the grounding plate 20 to the ground components within the receptacle 10.

The housing 11 is then moved into operative association with a face plate 18, such as a cover plate for a multiple electrical outlet strip, with the prong-receiving structures 14 extending through openings in the plate 18. A screw 17 is passed through an opening in the plate 18 and into screw-threaded opening 16 in receptacle face 13 to hold the receptacle in place, and serrated edges 23, 41 of grounding plate 20 and dummy grounding plate 40, respectively, engage the plate 18. The receptacle 10 is then grounded through face plate 18, a suitable connection being provided between an electrical plug cord ground wire and the face plate 18.

In a manner of utilizing the embodiment illustrated in FIGS. 6 through 7, the same steps are followed with respect to disposing grounding plate 120 in conjunction with receptacle housing 111, and connecting receptacle housing 111 to face plate 118. Then, ground wire 150 is inserted through the open end of V-shaped notch 152 of arm 151 (it may be soldered in place if desired) and the ground wire 150 is similarly placed in association with a plurality of other arms 151 of other receptacles 110, and ultimately connected to an electrical plug cord ground wire (when constructing a multiple electrical outlet strip or the like).

It will thus be seen that according to the present invention a receptacle, and a particular grounding plate for utilization with the receptacle, have been provided which facilitate quick, easy, and simple grounding of the receptacle.

While the invention has been herein shown and described in what is presently conceived to be the most practical and preferred embodiments thereof, it will be apparent to those of ordinary skill in the art that many modifications may be thereof within the scope of the invention, which scope is to be accorded the broadest interpretation of the appended claims so as to encompass all equivalent structures and devices.

What is claimed is:

1. A receptacle comprising a housing having hot and neutral wire receiving structures associated therewith and a ground screw provided at one end thereof, wherein the improvement comprises:

means associated with said ground screw for grounding the receptacle, said means comprising a grounding plate abutting said housing and having means defining an opening therein for receipt of said ground screw, and having a contoured surface extending away from said opening and for operatively engaging a ground object;

said receptacle comprising a face having an accessible operative component associated therewith, and a back; and said contoured surface comprising an arm extending outwardly from said receptacle back substantially perpendicular thereto, and having a ground wire-receiving surface manifestation formed thereon.

2. A receptacle as recited in claim 1 wherein said ground wire-receiving surface manifestation comprises a V-shaped notch extending substantially parallel to said ground screw-receiving opening.

3. A receptacle as recited in claim 1 wherein said ground wire-receiving surface manifestation comprises a strip having a tongue pressed therefrom to define an open-ended slot between the tongue and the remainder of the strip, for receiving a ground wire in said slot.

4. A receptacle as recited in claim 3 wherein said strip is disposed in a plane substantially perpendicular to the plane of said grounding plate portion having means defining an opening therein for receipt of said ground screw.

5. A receptacle as recited in claims 2 or 4 wherein said receptacle housing comprises a face, a back, first and second opposite long sides, and first and second opposite short sides; and wherein said first short side includes a center rib and a pair of indented faces, one on either side of said rib, said ground screw extending outwardly from one of said indented faces; and wherein said grounding plate comprises first and second spaced inner faces, receiving said rib therebetween and flush with said first short side indented faces, said first inner face having said ground screw-receiving opening therein; said arm being integral with and extending away from one of said inner faces; and a lip spaced from said inner faces substantially the depth of said rib and extending parallel to said inner faces, and engaging said receptacle housing.

6. A metal grounding plate for use with a receptacle having a ground screw, and comprising:

at least one inner face, having means defining an opening for receiving a ground screw therein;

a grounding face spaced from said inner face and extending parallel to said inner face, and having a serrated edge;

a web portion substantially perpendicular to said inner face and said grounding face, and interconnecting the same;

said web portion being integral with one edge of said grounding face; and said serrated edge of said grounding face being opposite and parallel to said one edge integral with said web portion.

7. A grounding plate as recited in claim 6 wherein said at least one inner face comprises first and second spaced, parallel inner faces, said first inner face having said ground screw-receiving opening therein.

8. A receptacle comprising a housing having hot and neutral wire receiving structures associated therewith and a ground screw provided at one end thereof;

means associated with said ground screw for grounding the receptacle, said means comprising a grounding plate abutting said housing and having means defining an opening therein for receipt of said ground screw, and having a contoured surface extending away from said opening and for operatively engaging a ground object;

said contoured surface comprising an elongated serrated edge extending toward a receptacle face and engaging a face plate covering said face; and said receptacle housing comprising a face, a back, first and second opposite long sides, and first and second opposite short sides; and wherein said first short side includes a center rib and a pair of indented faces, one on either side of said rib, said ground screw extending outwardly from one of said indented faces; and wherein said grounding plate comprises first and second spaced inner faces, receiving said rib therebetween and flush with said first short side indented faces, said first inner face having said ground screw receiving opening therein; and a grounding face spaced from said inner faces substantially the depth of said rib and extending parallel to said inner faces, and having said serrated edge formed thereon.

9. A receptacle as recited in claim 8 wherein said receptacle is mounted to a cover plate of a multiple electrical outlet strip; and wherein said face plate comprises said multiple electrical outlet strip cover plate.

10. A receptacle as recited in claims 1 or 8 wherein said receptacle housing comprises a face having as an accessible operative component thereof a duplex electrical outlet.

* * * * *